US006313077B1

(12) United States Patent
Stunnenberg et al.

(10) Patent No.: US 6,313,077 B1
(45) Date of Patent: Nov. 6, 2001

(54) USE OF POLYALPHAOLEFINS (PAO) DERIVED FROM DODECENE OR TETRADECENE TO IMPROVE THERMAL STABILITY IN ENGINE OIL IN AN INTERNAL COMBUSTION ENGINE

(75) Inventors: Frank Stunnenberg, Diemen (NL); Perla Duchesne, Notredame de Gravenchon (FR); Jurgen H. Raddatz, Darmstadt-Eberstadt (DE)

(73) Assignee: Phillips Petroleum Company, Bartlesville, OK (US)

( * ) Notice: Subject to any disclaimer, the term of this patent is extended or adjusted under 35 U.S.C. 154(b) by 0 days.

(21) Appl. No.: 09/624,286

(22) Filed: Jul. 24, 2000

(51) Int. Cl.[7] ..... C10M 107/02; C10M 105/02

(52) U.S. Cl. ..... 508/591; 585/10; 585/12; 585/18

(58) Field of Search ..... 508/591

(56) References Cited

U.S. PATENT DOCUMENTS

| | | | | |
|---|---|---|---|---|
| 4,218,330 | * | 8/1980 | Shubkin | 585/13 |
| 4,956,122 | * | 9/1990 | Watts et al. | 585/11 |
| 5,191,140 | * | 3/1993 | Akatsu et al. | 585/525 |
| 5,284,989 | * | 2/1994 | Apelian et al. | 585/533 |
| 5,595,966 | * | 1/1997 | Rees et al. | 508/591 |
| 6,071,863 | * | 6/2000 | Benda et al. | 508/591 |

* cited by examiner

*Primary Examiner*—Ellen M. McAvoy
(74) *Attorney, Agent, or Firm*—Reece A. Scott

(57) ABSTRACT

The present invention relates to compositions of base oils and automotive engine oils using synthetic poly alpha olefins derived from 1-dodecene or 1-tetradecene to improve engine oil performance as demonstrated by the severe Volkswagen T-4, Volkswagen TDI, and Sequence IIIE tests.

28 Claims, 1 Drawing Sheet

USE OF POLYALPHAOLEFINS (PAO) DERIVED FROM DODECENE OR TETRADECENE TO IMPROVE THERMAL STABILITY IN ENGINE OIL IN AN INTERNAL COMBUSTION ENGINE

FIELD OF THE INVENTION

The present invention relates to compositions of automotive engine oils using synthetic poly alpha olefins derived from 1-dodecene or 1-tetradecene, to improve engine oil performance, as demonstrated by the severe Volkswagen T-4, Volkswagen TDI, and Sequence IIIE tests.

BACKGROUND OF THE INVENTION

Today's automobiles tend to have smaller, more demanding engines operating at higher temperatures. Thus, the engine oil has to function in an increasingly severe environment while meeting fuel economy demands. Besides changes in the additive package, increasingly synthetic base oils are being used instead of conventional mineral oils. Of the synthetic oils, poly alpha olefins (PAO) are among the most popular.

PAO is manufactured by the oligomerization of linear alpha olefins followed by hydrogenation to remove unsaturated bonds and fractionation to obtain the desired product slate. 1-decene is the most commonly used alpha olefin in the manufacture of PAO, but 1-dodecene and 1-tetradecene can also be used. PAO's are commonly categorized by the numbers denoting the approximate viscosity in centistokes of the PAO at 100° C. It is known that PAO 2, PAO 2.5, PAO 4, PAO 5, PAO 6, PAO 7, PAO 8, PAO 9 and PAO 10 and combinations thereof can be used in engine oils. The most common of these are PAO 4, PAO 6 and PAO 8.

Conventionally, base oils of lubricating viscosity used in motor oil compositions may be mineral oil or synthetic oils of viscosity suitable for use in the crankcase of an internal combustion engine. Crankcase base oils ordinarily have a viscosity of about 1300 cSt at 0° F. (−18° C.) to 24 cSt at 210° F. (99° C.). The base oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters.

Although the common 1-decene based PAO 4, 6 and 8 offer better performance than mineral oil based engine oils, they encounter difficulties when subjected to the severe PV 1449, CEC L-78-T-96 and Sequence IIIE tests. The PV 1449 and Sequence IIIE tests evaluate fully formulated engine oils with respect to high temperature oxidative stability and piston deposits. The CEC L-78-T-96 test evaluates fully formulated engine oils with respect to piston cleanliness and piston ring sticking. The PV 1449 and CEC L-78-T-96 tests will be referred to hereinafter as the Volkswagen T-4 and TDI engine tests, respectively.

It has been found to be difficult to blend an engine oil of the desired 0W30 viscosity grade based on PAO 4 and 6 that successfully completes the TDI test. Repeatedly, it was found that too low oil pressure caused the engine to fail from 2 to 8 hours before the end of the test. In the T-4 test, it was found that the increase in engine oil viscosity resulting in engine failure during the test was related to oil oxidation stability and volatility. To pass the T-4 test, it was found that the PAO 4/6 based engine oil requires large quantities of expensive anti-oxidants. The other way to obtain PAO 4/6 based oil which passes the T-4 test is to use an expensive fully synthetic oil.

The Volkswagen T-4 and TDI tests have recently become an important measure of engine lubrication oil quality under very severe conditions. The Sequence IIIE test is analogous to a T-4 test but is specifically developed for U.S. built engines. The T-4 and Sequence IIIE tests are for gasoline engines and the TDI test is for diesel engines. They replicate the severe engine conditions put on motor lubrication oil by sustained, very high speed driving, as on the German Autobahn. What is needed is a PAO based oil which is able to successfully complete severe engine tests such as the Volkswagen T-4 and TDI tests and the Sequence IIIE test without having to use large quantities of anti-oxidants or a fully synthetic oil.

Surprisingly, it has been found that lubrication oils based on a feed consisting of 1-dodecene or 1-tetradecene, and that have approximate viscosities at 100° C. of from 3.5 to 8.5 centistokes, successfully pass the T-4 and TDI tests with PAO based oil weight percentages much lower than previously achieved. This represents a major development in the search for an economical lubrication oil that is well suited for modern driving conditions.

SUMMARY OF THE INVENTION

In its broadest aspect the present invention relates to a base oil composition suitable for use in an engine oil which comprises a mixture of trimer and higher oligomers derived from an alpha olefin feed consisting essentially of either 1-dodecene or 1-tetradecene wherein said oligomer mixture contains less than 2 weight percent of combined monomer and dimer. When used in this specification the phrase" consisting essentially of either 1-dodecene or 1-tetradecene" refers to a feed which contains at least 85% by weight of 1-dodecene or 1-tetradecene. In the preferred embodiment of the invention the base oil composition will consist essentially of only the trimer and higher oligomers of either 1-dodecene or 1-tetradecene. The term "oligomer mixture" as used herein is intended to mean a mixture of the different oligomers of either dodecene or tetradecene. It is not intended to mean a mixture of oligomers derived from alpha olefins other than dodecene or tetradecene.

The present invention also relates to the use of PAO oil as a base oil, or as a component of a base oil, in an engine oil for the purpose of improving the high temperature stability wherein the PAO oil comprises a mixture of trimer and higher oligomers derived from an olefin feed consisting of either 1-dodecene or 1-tetradecene wherein said oligomer mixture contains less than 2 weight percent of combined monomer and dimer.

In another embodiment, the present invention relates to the use of the PAO derived from 1-dodecene or 1-tetradecene as a base oil, or a component of a base oil, in an engine oil comprised of said base oil, in addition to dispersants, detergents, oxidation inhibitors, foam inhibitors, anti-wear agents and at least one viscosity index improver, for the purpose of improving the high temperature stability of the engine oil to at least the point at which the engine oil is able to pass the VW T-4, VW TDI, or Sequence IIIE tests. Preferably, the base oil comprises between 15 to 85 weight percent of the engine oil and at least 15 weight percent of the base oil consists of the PAO derived from 1-dodecene or 1-tetradecene.

The PAO derived from 1-dodecene or 1-tetradecene, as used in the present invention, preferably will have a viscosity at 100° C. of between about 3.5 centistokes to about 9.5 centistokes. Particularly preferred for use in manufacturing base oils of the present invention are those PAO's having a viscosity at 100° C. of approximately 5 centistokes, approximately 6 centistokes, or approximately 7 centistokes, i.e, PAO 5, PAO 6, or PAO 7. Especially preferred for use in the present invention are PAO 5 and PAO 7. The viscosity of the PAO will depend upon the relative percentage of the various oligomers present in the product. In general, the higher the percentage of higher molecular weight oligomers, the higher the viscosity of the PAO. Thus for example, in the case of dodecene, PAO 5 would have a higher percentage of trimer present than PAO 6 or PAO 7. PAO 7 would have a higher percentage of tetramer or higher oligomers than PAO 5 or PAO 6. The different viscosity PAO's are readily separated by distillation to yield the desired oligomer cut.

As used in this disclosure the words "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. When specifically referring to the feed composition the phrase "consisting essentially of either 1-dodecene or 1-tetradecene" refers to a feed which contains at least 85% by weight of 1-dodecene or 1-tetradecene. The phrases "consisting of" or "consists of" are intended as a transition meaning the exclusion of all but the recited elements with the exception of only minor traces of impurities.

Unless explicitly stated otherwise, all percentages in this specification refer to percent by weight.

BRIEF DESCRIPTION OF THE DRAWINGS

In order to assist the understanding of this invention, reference will now be made to the appended drawings. The drawings are exemplary only, and should not be construed as limiting the invention.

DETAILED DESCRIPTION OF THE INVENTION

Figure 1:
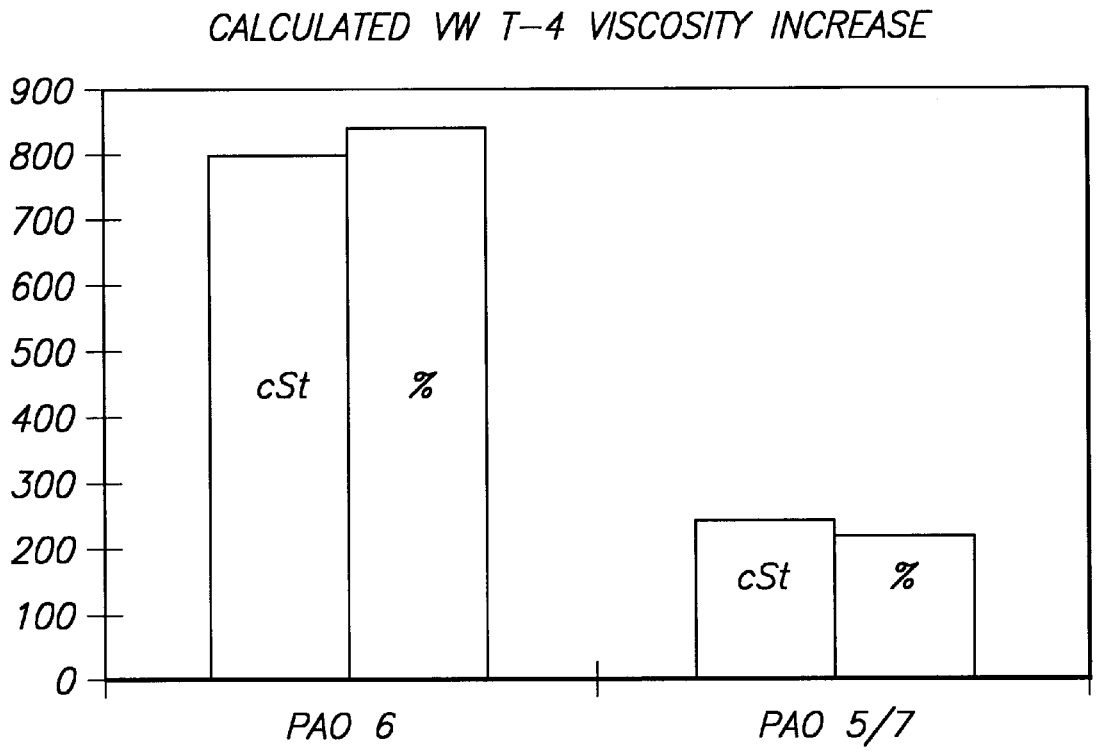
FIG. 1 is a graph comparing the absolute and relative T-4 viscosity increases in PAO 6 and PAO 5/7 based motor oil in an experiment the conditions of which are described in Example 5.

As discussed above, the present invention is concerned with improving the thermal stability, oxidative stability, and volatility characteristics of engine oil by using a base oil composition prepared from PAO derived from the oligomers of 1-dodecene or 1-tetradecene. The amount of monomer and dimer present in the PAO used for preparing the base oil of the present invention should comprise no more than 2.0 weight percent. Preferably the PAO should consist only of trimers or higher oligomers of 1-dodecene or 1-tetradecene. Surprisingly, it has been found that PAO 5 and PAO 7 derived from 1-dodecene or 1-tetradecene offer superior thermal stability, oxidation stability, and volatility characteristics when used as a base oil as compared to PAO 4 and PAO 6 derived from decene. As the examples below show, such improved oxidation stability is found in both gasoline (T-4) and diesel (TDI) engines (especially direct injection diesels). Furthermore, the superior oxidation stability qualities are shown in both fully synthetic as well as semi-synthetic engine oils, which are a mixture of PAO's and mineral oils. PAO 5/7 when used as a base oil has also been shown to be superior over PAO 4/6/8 in PSA TU3M high temperature gasoline tests and Sequence IIIE high temperature oxidation tests.

As discussed above, it is essential that the alpha olefin feed used to prepare the PAO which in turn is used to prepare the base oil be a relatively pure feed of either 1-dodecene or 1-tetradecene, i.e., containing no more than 15% by weight of other alphaolefins. Mixtures containing more than 15% by weight of other alpha olefins are not suitable as a feedstock in preparing the PAO used in the practice of the present invention. More preferably the feed will contain less than 10% by weight of other alphaolefins. In addition, the PAO should never contain more than 2 weight percent of dimer or residual monomer. Accordingly, the carbon chains of the PAO used to prepare the base oils of the present invention will contain multiples of either 12 or 14 carbon atoms, such as, in the case of dodecene, 36, 48, 60 carbon atoms, etc. or in the case of tetradecene, 42, 56, 70 carbon atoms, etc. This molecular consistency has been found to impart some very desirable properties to the base oil prepared from the PAO, as for example, the ability to pass the very stringent VW T-4 test.

Generally for base oils used to prepare 0W-20-50 SAE viscosity grade engine oils, the PAO will comprise from 50% to 85% by weight of the base oil. For base oils used to prepare 5W-20-50 SAE viscosity grade engine oils, the PAO will comprise from 15% to 50% by weight of the base oil. For base oils used to prepare 10W-20-50 SAE viscosity grade engine oils, the PAO will comprise from 5% to 35% by weight of the base oil.

In addition to the base oil derived from the PAO of the present invention, commercial engine oils typically contain various other additives, such as dispersants, detergents, anti-wear agents, oxidation inhibitors, foam inhibitors, and viscosity index improvers. These other additives used in the formulation of a typical engine oil are discussed below.

ADDITIVE COMPONENTS

The following additive components represent examples of some components that can be favorably employed in preparing engine oils of the present invention. These examples of additives are provided to illustrate the present invention, but they are not intended to limit it:

(1) Metal detergents: sulfurized or unsulfurized alkyl or alkenyl phenates, alkyl or alkenyl aromatic sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multi-acid, metal salts of an alkyl salicylic acid, carboxylates, overbased detergents and chemical and physical mixtures thereof.

(2) Ashless dispersants: alkenyl succinimides, alkenyl succinimides modified with other organic compounds, and alkenyl succinimides modified with boric acid, alkenyl succinic ester.

(3) Oxidation inhibitors:

(a) Phenol type oxidation inhibitors: 4,4'-methylenebis (2,6-di-tert-butylphenol), 4,4'-bis(2,6-di-tert-butylphenol), 4,4'-bis(2-methyl-6-tert-butylphenol), 2,2'-(methylenebis(4-methyl-6-tert-butyl-phenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'- methylenebis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-4-(N.N' dimethylaminomethylphenol), 4,4'-thiobis(2-methyl-6-tert-butylphenol), 2,2'-thiobis (4-methyl-6-tert-butylphenol), bis(3-methyl-4-hydroxy-5-tert-butylbenzyl)-sulfide, and bis (3,5-di-tert-butyl4-hydroxybenzyl).

(b) Diphenylamine type oxidation inhibitor: alkylated diphenylamine, phenyl-I-naphthylamine, and alkylated I-naphthylamine.

(c) Other types: metal dithiocarbamate (e.g., zinc dithiocarbamate), and methylenebis (dibutyidithiocarbamate).

(4) Rust inhibitors (Anti-rust agents):

(a) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

(b) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(5) Demulsifiers: addition product of alkylphenol and ethyleneoxide, polyoxyethylene alkyl ether, and polyoxyethylene sorbitan ester.

(6) Extreme pressure agents (EP agents): zinc dithiophosphates, zinc dithiocarbamates, zinc dialkyldithiophosphate (primary alkyl type & secondary alkyl type), zinc diaryl dithiophosphate, sulfurized oils, diphenyl sulfide, methyl trichlorostearate, chlorinated naphthalene, fluoroalkylpolysiloxane, and lead naphthenate.

(7) Friction modifiers: fatty alcohol, fatty acid, amine, borated ester, and other esters.

(8) Multifunctional additives: sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenum complex compound.

(9) Viscosity index improvers: polymethacrylate type polymers, ethylene-propylene copolymers, styrene-isoprene copolymers, hydrated styrene-isoprene copolymers, polyisobutylene, and dispersant type viscosity index improvers.

(10) Pour point depressants: polymethyl methacrylate.

(11) Foam Inhibitors: alkyl methacrylate polymers and dimethyl silicone polymers.

In one embodiment, an engine lubricating oil composition would contain:

(a) a major part of a base oil of lubricating viscosity, wherein the base oil comprises 1-dodecene and/or 1-tetradecene-derived polyalphaolefins;

(b) 0% to 20% of at least one ashless dispersant;

(c) 0% to 30% of the detergent;

(d) 0% to 5% of at least one zinc dithiophosphate;

(e) 0% to 10% of at least one oxidation inhibitor;

(f) 0% to 1% of at least one foam inhibitor; and (g) 0% to 20% of at least one viscosity index improver.

In a further embodiment of the present invention, an engine lubricating oil composition is produced by blending a mixture of the above components. The lubricating oil composition produced by that method might have a slightly different composition than the initial mixture, because the components may interact. The components can be blended in any order and can be blended as combinations of components. In general, most engine oil compositions will contain between 5% and 85% by weight of base oil.

A preferred engine oil composition of the present invention will include from 0 to about 20 weight percent of at least one ashless dispersant, from 0 to about 30 weight percent of detergent, from 0 to about 5 weight percent of at least one anti-wear agent, from 0 to about 10 weight percent of at least one oxidation inhibitor, from 0 to about 1 weight percent of at least one foam inhibitor, and from 0 to about 20 weight percent of at least on viscosity improver.

In addition to the compositions discussed above, preferred engine oil compositions having a SAE viscosity grade of 0W20-40 are comprised of from 15 to 85% of a base oil containing from 50 to 85% of PAO at least 15 weight percent of which is derived from 1-dodecene or 1-tetradecene according to the present invention. Likewise, in the case of engine oil compositions having a SAE viscosity grade of 5W20-40, the compositions are preferably comprised of from 15 to 85 weight percent of a base oil containing from 15 to 50 weight percent of PAO at least 15 weight percent of which is derived from 1-dodecene or 1-tetradecene. For those engine oil compositions having a SAE viscosity grade of 10W20-50 are comprised of from 15 to 85 weight percent of a base oil containing from 5 to 35 weight percent of PAO at least 15 weight percent of which is derived from 1-dodecene or 1-tetradecene.

ADDITIVE CONCENTRATES

Additive concentrates are also included within the scope of this invention. The concentrates of this invention comprise the compounds or compound mixtures of the present invention, with at least one of the additives disclosed above. Typically, the concentrates contain sufficient organic diluent to make them easy to handle during shipping and storage.

From 20% to 80% of the concentrate is organic diluent. Suitable organic diluents which can be used include for example, solvent refined 100N, i.e., Cit-Con 100N, and hydrotreated 100N, i.e., RLOP 100N, and the like. The organic diluent preferably has a viscosity of from about 1 to about 20 cSt at 100° C.

EXAMPLES

The invention will be further illustrated by the following examples, which set forth particularly advantageous embodiments. While the Examples are provided to illustrate the present invention, they are not intended to limit it.

Examples 1 through 4 cover bench test data obtained in the proprietary MAO 92 oxidation bench test. In this test, air is bubbled through an oil sample at elevated temperature. The oil sample contains an oxidation catalyst. The viscosity of the oil at 40° C. is measured at regular intervals until 1000 cSt is reached. The time to reach this value is a measure of the stability. The longer the time, the better the oxidation stability. The MAO 92 oxidation test has a repeatability of 7 hours. PAO 5 and 7 referred to in the following examples are derived from 1-dodcene according to the present invention. PAO 4, 6, and 8 are derived from 1-decene.

EXAMPLE 1

A fully formulated engine oil was prepared, containing an additive package comprised of 6% dispersant, 71.5 mmol detergent, 15.5 mmol zinc dithiophosphate, 0.55% supplementary additives, 2.0% VII, 34.8% Esso 145N, 20.55% Esso 600N and 15% PAO 5 and 15% PAO 7. This oil was subjected to the MAO 92 oxidation test, the result being 125 hours.

COMPARATIVE EXAMPLE 2

As a comparison, a similar engine oil as described in Example 1 was prepared. However, the 15% PAO 5 and 15% PAO 7 were replaced by 30% PAO 6. The result of the oxidation test was only 100 hours.

EXAMPLE 3

The experiment of Example 1 was repeated using an additive package comprised of 6% dispersant, 71.5 mmol detergent, 15.5 mmol zinc dithiophosphate, 0.55% supplementary additives, 2.0% VII, 52% PAO 5 and 33.3% PAO 7. The result in the oxidation test is 162 hours.

COMPARATIVE EXAMPLE 4

As a comparison to Example 3, the PAO 5 and 7 were replaced by 11.1% PAO 4 and 74.2% PAO 6. The result in the oxidation test, 152 hours, was poor in comparison to the oil of Example 3.

EXAMPLE 5

The oils of Example 1 and Comparative Example 2 were subjected to the bench tests used to mimic the viscosity increase of the VW T-4 engine test. The lower the absolute and relative viscosity increase, the better the test result. As can be seen in FIG. 1, the oil based on PAO 5/7 is far superior to the oil based on PAO 6.

TABLE 1

| Oil code | OIL 10 | OIL 11 |
|---|---|---|
| Additive package | AP7 | AP7 |
| PAO 5 | | 15 |
| PAO 6 | 30 | |
| PAO 7 | | 15 |
| Calculated T-4 viscosity (cSt) | 756.6 | 201.8 |
| Calculated T-4 viscosity increase (%) | 819.0 | 189.7 |

EXAMPLE6

Figure 2:
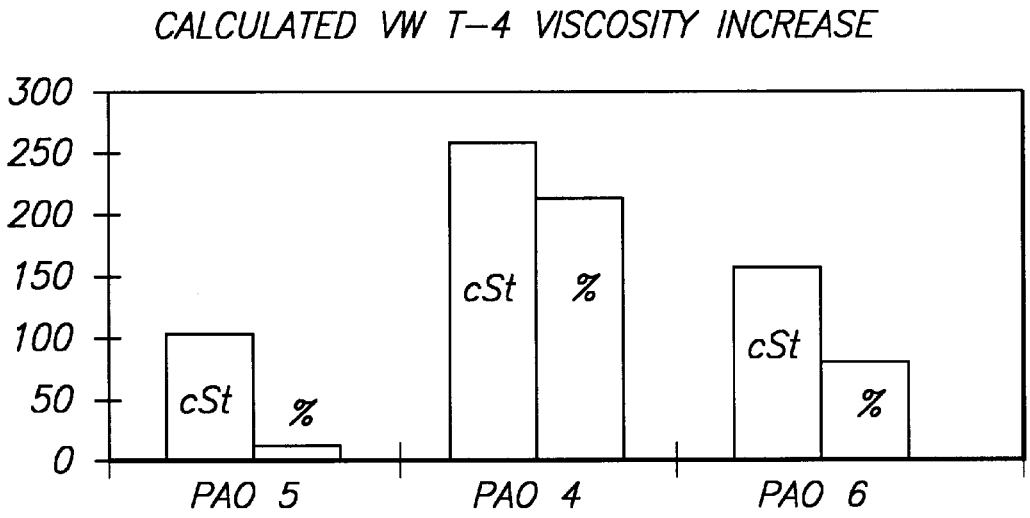
FIG. 2 is a graph comparing the absolute and relative T-4 viscosity increases in PAO 4, PAO 5 and PAO 6 based motor oil in an experiment the conditions of which are described in Example 6.

A fully formulated engine oil was prepared containing an additive package comprised of 6% dispersant, 87 mmol detergent, 19 mmol zinc dithiophosphate and 0.35% supplementary additives, 10.3% VII and 30% PAO 5, the balance made up by mineral base stock. Two similar engine oils were prepared but the 30% PAO 5 was replaced by 30% PAO 4 and 30% PAO 6, respectively. These three oils were subjected to the bench tests used to mimic the viscosity increase of the VW T-4 engine test. The lower the absolute and relative viscosity increase, the better the test result. As can be seen in FIG. 2, the oil based on PAO 5 is far superior to the oils based on PAO 4 and PAO 6.

TABLE 2

| Oil code | OIL 13 | OIL 12 | OIL 14 |
|---|---|---|---|
| Additive package | AP4 | AP4 | AP4 |
| PAO 5 | 30 | | |
| PAO 4 | | 30 | |

TABLE 2-continued

| Oil code | OIL 13 | OIL 12 | OIL 14 |
|---|---|---|---|
| PAO 6 | | | 30 |
| Calculated T-4 viscosity (cSt) | 99.4 | 258.2 | 154.3 |
| Calculated T-4 viscosity increase (%) | 10.5 | 212 | 79.5 |

EXAMPLE 7

A fully formulated engine oil was prepared containing an additive package 5 comprised of 6.5% dispersant, 98 mmol detergent, 5.5 mmol zinc dithiophosphate and 1.8% supplementary additives, 4.0% VI improver and the balance a 57.6/42.4 mixture of PAO 4 and PAO 6. This oil was run in the VW TDI engine. The test was aborted after 52 hours, i.e., 8 hours before reaching the end-of-test, as result of low oil pressure due to a lack of engine oil remaining in the sump.

A VW TDI test was conducted on a 1.9 liter turbo charged, intercooled DI diesel type engine. The engine tested has power of 81 kW at 4150 rpm's. There are 4 cylinders in the engine measuring 79.5×95.5 mm (b×s). EGR is not activated in the engine and the oil charge is 4.5 liters. The test procedure had a 5 hour run-in step, a 3 hour power curve step, and a 2 hour flushing step.

These steps were followed by a 60 hour cycling step which had two stages: stage 1, the idling stage; and stage 2, the full load stage. One cycle takes three hours and the cycle was repeated 20 times (20×3 hrs.). Further facts about the cycling stage are given in Table 3 below.

TABLE 3

| CEC L-78-T-96 (TDI) Engine Test Test Conditions | Stage 1 | Stage 2 |
|---|---|---|
| Duration (minutes) | 30 | 150 |
| Speed (rpm) | Idle | 4150 |
| Oil Temperature (° C.) | 40 | 145 |
| Coolant Temperature (° C.) | 30 | 90 |
| Boost Air Temperature (° C.) | 30 | 60 |

COMPARATIVE EXAMPLE 8

As a comparison to Example 7, the PAO 4 and 6 were replaced by 8.6% PAO 5 and 91.4% PAO 7. The oil successfully completed the 60 hour VW TDI engine test.

EXAMPLE 9

T-4 bench tests and engine tests were performed on oil compositions containing various additives, including viscosity index improvers and various proportions of PAO 4, PAO 5, PAO 6, PAO 7, PAO 8 and mineral stock. Tables 4A through 4D show the T-4 bench test and engine test results as well as the MAO 92 results for the compositions. These results show the correlation between the engine test results and the bench test model for both the absolute viscosity at end-of-test (EOT) and also for the relative viscosity increase. Both are requirements for the T-4 test.

The Engine Test Conditions for conducting the VW T-4 test are given below in Table 4. The total test had a duration of 262 hours (10 hours run-in, +2 hours power curve, +2 hours flushing, +48×PNK cycles=48×4=192 hrs, +56 hrs N cycle→262 hours). The test oil charge was 5 liters with no oil top-up allowed. Of the various test requirements, the limits on viscosity increase are the most difficult to achieve. Both relative viscosity increase as well as absolute viscosity increase at EOT are limited. The limits are as follows: EOT Viscosity at 40° C.<200 cSt. EOT Viscosity increase <130%.

TABLE 4A

| Oil Code | OIL 1 | OIL 2 | OIL 3 |
|---|---|---|---|
| Additive Package | AP1 | AP2 | AP3 |
| --dispersant (wt %) | n.a. | 5 | 6.75 |
| --detergent (mmol) | n.a. | 84 | 70 |
| -zinc dithiophosphate (mmol) | n.a. | 18 | 18 |
| -supplementary additives (wt %) | n.a. | 1.6 | 0.93 |
| VI Improver (%) | n.a. | 4.7 | 10.5 |
| VI Improver | | polymethyl-acrylate type polymers (PMA) | ethylene propylene copolymers (OCP) |
| PAO 4 | n.a. | | |
| PAO 5 | n.a. | | |
| PAO 6 | n.a. | 62.1 | 25 |
| PAO 7 | n.a. | | |
| PAO 8 | n.a. | 20 | |
| Mineral Stock (%) | n.a. | | 50.6 |
| Mineral Stock | n.a. full synth. | | Group 1 |
| TGA (° C.) | 336.8 | 342.5 | 312.5 |
| MAO 92-visc. at 100 H (cSt) | 69.3 | 125.9 | 180.1 |
| MAO 92-visc. increase at 100 H (%) | −9.8 | 65.9 | 87.1 |
| Calculated VW T-4 viscosity increase (cSt) | 107.8 | 114.1 | 302.8 |
| Calculated VW T-4 viscosity increase (%) | 47.9 | 55.3 | 264.0 |
| Act. T-4 visc. increase (cSt) | 134.2 | 107.0 | 450.9 |
| Act. T-4 visc. increase (%) | 74.5 | 41.0 | 368.5 |

TABLE 4B

| Oil Code | OIL4 | OIL5 | OIL6 |
|---|---|---|---|
| Additive Package | AP2 | AP4 | AP5 |
| --dispersant (wt %) | 5 | 6 | 6.5 |
| --detergent (mmol) | 84 | 87 | 98 |
| -zinc dithiophosphate (mmol) | 18 | 19 | 15.5 |
| -supplementary additives (wt %) | 1.6 | 0.35 | 1.8 |
| VI Improver (%) | 6.2 | 9 | 6.3 |
| VI Improver | OCP | OCP | Styrene isoprene copolymers (Styr.-IP) |
| PAO 4 | | | 45.5 |
| PAO 5 | | | |
| PAO 6 | 21.8 | 23.5 | 13.1 |
| PAO 7 | | | |
| PAO 8 | | | |
| Mineral Stock (%) | 58.8 | 55 | 20 |
| Mineral Stock | Group I | Group I | Group II |
| TGA (° C.) | 316.2 | 318.7 | 320 |
| MAO 92-visc. at 100 H (cSt) | 1344.6 | 190.9 | 74 |
| MAO 92-visc. increase at 100 H (%) | 1326.5 | 108.7 | 32.3 |
| Calculated VW T-4 viscosity increase (cSt) | 1017.4 | 277.2 | 197.3 |
| Calculated VW T-4 viscosity increase (%) | 971.1 | 236.2 | 182.7 |
| Act. T-4 visc. increase (cSt) | Too viscous to measure | 335.4 | 151.7 |
| Act. T-4 visc. increase (%) | | 268.0 | 171.2 |

TABLE 4C

| Oil Code | OIL7 | OIL8 | OIL9 |
|---|---|---|---|
| Additive Package | AP5 | AP5 | AP6 |
| --dispersant (wt %) | 6.5 | 6.5 | 6 |
| --detergent (mmol) | 98 | 98 | 93 |
| -zinc dithiophosphate (mmol) | 15.5 | 15.5 | 19 |
| -supplementary additives (wt %) | 1.8 | 1.8 | 1.6 |
| VI Improver (%) | 5.2 | 5.0 | 5.0 |
| VI Improver | Styr.-IP | Styr.-IP | Styr.-IP |
| PAO 4 | 43 | 15.98 | 15.98 |
| PAO 5 | | 63.92 | 63.92 |
| PAO 6 | 36.7 | | |
| PAO 7 | | | |
| PAO 8 | | | |
| Mineral Stock (%) | | | |
| Mineral Stock | | | |
| TGA (° C.) | 314 | 353 | 355 |
| MAO 92-visc. at 100 H (cSt) | 53.8 | 51.1 | −25.4 |
| MAO 92-visc. increase at 100 H (%) | −1.3 | 50.5 | −25.3 |
| Calculated VW T-4 viscosity increase (cSt) | 215.5 | 12.9 | −45.6 |
| Calculated VW T-4 viscosity increase (%) | 202.1 | −22.4 | −80.2 |
| Act. T-4 visc. increase (cSt) | 115.0 | | |
| Act. T-4 visc. increase (%) | 108.0 | | |

TABLE 4D

| Oil Code | OIL10 | OIL11 |
|---|---|---|
| Additive Package | AP7 | AP7 |
| --dispersant (wt %) | 6 | 6 |
| --detergent (mmol) | 71.5 | 71.5 |
| -zinc dithiophosphate (mmol) | 15.5 | 15.5 |
| -supplementary additives (wt %) | 0.55 | 0.55 |
| VI Improver (%) | 2.0 | 2.0 |
| VI Improver | OCP | OCP |
| PAO 4 | | |
| PAO 5 | | 15 |
| PAO 6 | 30 | |
| PAO 7 | | 15 |
| PAO 8 | | |
| Mineral Stock (%) | 55.3 | 55.3 |
| Mineral Stock | Group I | Group I |
| TGA (° C.) | 310 | 325 |
| MAO 92-visc. at 100 H (cSt) | 880 | 122 |
| MAO 92-visc. increase at 100 H (%) | 1000 | 99.7 |
| Calculated VW T-4 viscosity increase (cSt) | 756.6 | 201.8 |
| Calculated VW T-4 viscosity increase (%) | 819.0 | 189.7 |
| Act. T-4 visc. increase (cSt) | | |
| Act. T-4 visc. increase (%) | | |

TABLE 5

VW PV 1449 ENGINE TEST (T-4)
Test Conditions

| PNK Cycles | Max Power P | Max $NO_x$ N | Cold Idling K | Max $NO_x$ N |
|---|---|---|---|---|
| Duration | 120 min | 72 min | 48 min | 56 hrs |
| RPM | 4300 | 4300 | 900 | 4300 |
| Oil Sump Temp ° C. | 133 | 130 | 40 | 130 |
| Coolant Temp ° C. | 100 | 100 | 30 | 100 |
| Power kW | 62 | 34 | 0 | 34 |
| Torque Nm | 140 | 75 | 0 | 75 |
| Fuel Cons. kg/h | 19.4 | 10.8 | 1.1 | 10.8 |
| Exh. Gas Temp ° C. | 820 | 763 | 292 | 763 |

EXAMPLE 10

Bench Test Thermal Gravimetric Analysis (TGA) of PAO 5 and 7

Bench test analysis was performed on four different samples of oil to find the TGA DPeak (i.e. the temperature at which the weight loss, due to both evaporation and thermal degradation, of the oil is the most important, which correlates with oil consumption). This test measures the weight variation of a sample as a function of temperature, under a nitrogen flow. At a certain temperature, defined as the DPeak, the weight loss is the most important. The exact DPeak value is determined as the maximum of the derivative curve. The repeatability of the TGA test is equal to 8° C. Table 6 shows the results which support the superiority of PAO 5 and 7 in a bench scale test.

TABLE 6

| | Test 1 | Test 2 | Test 3 | Test 4 |
|---|---|---|---|---|
| Dispersant wt % | 6.5 | 6.5 | 6 | 6 |
| Detergent mmol | 98 | 98 | 71.5 | 71.5 |
| Zinc dithiophosphate mmol | 15.5 | 15.5 | 15.5 | 15.5 |
| Supplementary additives wt % | 1.8 | 1.8 | 0.55 | 0.55 |
| VII wt % | 5.2 | 5.2 | 2.0 | 2.0 |
| PAO 4/6 wt % | 43/36.7 | | | |
| PAO 4/5 wt % | | 15.98/63.92 | | |
| PAO 6 wt % | | | 30 | |
| PAO 5/7 wt % | | | | 30 |
| Mineralstock wt % | | | 55.3 Esso | 55.3 Esso |
| TGA (° C.) | 314 | 353 | 310 | 325 |

EXAMPLE 11

A fully formulated engine oil was prepared, containing 13.6% of an additive package, 6.9% VI Improver, 10% ester and 35% PAO 5 and 34.5% PAO 7. A Seq. IIIE test was run on this oil with a 1986 3.8 liter Buick V6 engine using leaded gasoline. The initial oil fill is 5.3 liters. Total test duration is 64 hours. The engine speed is 3000 rpm with a load of 50.6 kW. The oil temperature is 149° C. The results of the test were as follows:

| | |
|---|---|
| viscosity increase: | −11% |
| time to 375% vis. incr.: | 87.3 hours |
| Aver. engine sludge: | 9.7 |
| oil consumption, liter | 0.67 |

As a comparison, a similar engine oil as described above was prepared. However, the 35% PAO 5 and 34.5% PAO 7 were replaced by 69.5% PAO 6. Again, a Seq. IIIE was run, resulting in:

| | |
|---|---|
| viscosity increase: | −1% |
| time to 375% vis. incr.: | 85.8 hours |
| Aver. engine sludge: | 9.6 |
| oil consumption, liter | 1.14 |

The results show the superiority of PAO 5 and 7 over PAO 6 in the Seq. IIIE test.

While the present invention has been described with reference to specific embodiments, this application is intended to cover those various changes and substitutions that may be made by those skilled in the art without departing from the spirit and scope of the appended claims.

What is claimed is:

1. A base oil suitable for use in an engine oil which comprises an oligomer mixture of trimer and higher oligomers derived from an alpha olefin feed consisting essentially of 1-dodecene wherein said oligomer mixture contains less than 2 weight percent of combined monomer and dimer.

2. A base oil according to claim 1 wherein the base oil consists essentially of trimer and higher oligomers of said 1-dodecene.

3. The base oil of claim 2 wherein said alpha olefin feed consists essentially of at least 85% by weight said 1-dodecene.

4. An engine oil comprising between 50% and 85% by weight of the base oil of claim 1.

5. The engine oil of claim 4 further including from 0 to about 20 weight percent of at least one ashless dispersant, from 0 to about 30 weight percent of detergent, from 0 to about 5 weight percent of at least one anti-wear agent, from 0 to about 10 weight percent of at least one oxidation inhibitor, from 0 to about 1 weight percent of at least one foam inhibitor, and from 0 to about 20 weight percent of at least one viscosity improver.

6. An engine oil according to claim 5 having an SAE viscosity grade of 0W-20-40 comprising from 15 to 85% by weight of the base oil which is comprised of from 50 to 85% by weight of PAO, wherein at least 15% by weight of said PAO is derived from said 1-dodecene.

7. An engine oil according to claim 5 having an SAE viscosity grade of 5W-20-50 comprising from 15 to 85% by weight of the base oil which is comprised of from 15 to 50% by weight of PAO, wherein at least 15% by weight of said PAO is derived from said 1-dodecene.

8. An engine oil according to claim 5 having an SAE viscosity grade of 10W-20-50 comprising from 15 to 85% by weight of the base oil which is comprised of from 5 to 35% by weight of PAO, wherein at least 15% by weight of said PAO is derived from said 1-dodecene.

9. A method for improving the thermal stability, oxidative stability, and volatility characteristics of engine oil which comprises using a base oil comprised of PAO derived from a linear alpha olefin feed consisting essentially of 1-dodecene.

10. The method of claim 9 wherein the PAO has a viscosity at 100° C. of between about 3.5 to about 9.5 centistokes.

11. The method of claim 10 wherein the PAO has an approximate viscosity at 100° C. of 5 centistokes.

12. The method of claim 10 wherein the PAO has an approximate viscosity at 1 00°C. of 7 centistokes.

13. An engine oil able to pass the VW T-4, VW TDI, or Sequence IIIE tests which comprises from about 5 to about 85 weight percent of a base oil, from 0 to about 20 weight percent of at least one ashless dispersant, from 0 to about 30 weight percent of detergent, from 0 to about 10 weight percent of at least one oxidation inhibitor, from 0 to about 1 weight percent of at least one foam inhibitor, and from 0 to about 20 weight percent of at least one viscosity improver, wherein the base oil comprises a mixture of trimer and higher oligomers derived from an alpha olefin feed consisting essentially of 1-dodecene and wherein said oligomer mixture contains less than 2 weight percent of combined monomer and trimer.

14. The engine oil of claim 13 wherein the base oil consists of trimer and higher oligomers derived from said 1-dodecene.

15. A base oil suitable for use in an engine oil which comprises an oligomer mixture of trimer and higher oligomers derived from an alpha olefin feed consisting essentially of 1-tetradecene wherein said oligomer mixture contains less than 2 weight percent of combined monomer and dimer.

16. A base oil according to claim 15 wherein the base oil consists essentially of trimer and higher oligomers of said 1-tetradecene.

17. The base oil of claim 16 wherein said alpha olefin feed consists essentially of at least 85% by weight said 1-tetradecene.

18. An engine oil comprising between 50% and 85% by weight of the base oil of claim 15.

19. The engine oil of claim 18 further including from 0 to about 20 weight percent of at least one ashless dispersant, from 0 to about 30 weight percent of detergent, from 0 to about 5 weight percent of at least one anti-wear agent, from 0 to about 10 weight percent of at least one oxidation inhibitor, from 0 to about 1 weight percent of at least one foam inhibitor, and from 0 to about 20 weight percent of at least one viscosity improver.

20. An engine oil according to claim 19 having an SAE viscosity grade of 0W-20-40 comprising from 15 to 85% by weight of the base oil which is comprised of from 50 to 85% by weight of PAO, wherein at least 15% by weight of said PAO is derived from said 1-tetradecene.

21. An engine oil according to claim 19 having an SAE viscosity grade of 5W-20-50 comprising from 15 to 85% by weight of the base oil which is comprised of from 15 to 50% by weight of PAO, wherein at least 15% by weight of said PAO is derived from said 1-tetradecene.

22. An engine oil according to claim 19 having an SAE viscosity grade of 10W-20-50 comprising from 15 to 85% by weight of the base oil which is comprised of from 5 to 35% by weight of PAO, wherein at least 15% by weight of said PAO is derived from said 1-tetradecene.

23. A method for improving the thermal stability, oxidative stability, and volatility characteristics of engine oil which comprises using a base oil comprised of PAO derived from a linear alpha olefin feed consisting essentially of 1-tetradecene.

24. The method of claim 23 wherein the PAO has a viscosity at 100° C. of between about 3.5 to about 9.5 centistokes.

25. The method of claim 24 wherein the PAO has an approximate viscosity at 100° C. of 5 centistokes.

26. The method of claim 24 wherein the PAO has an approximate viscosity at 100° C. of 7 centistokes.

27. An engine oil able to pass the VW T-4, VW TDI, or Sequence IIIE tests which comprises from about 5 to about 85 weight percent of a base oil, from 0 to about 20 weight percent of at least one ashless dispersant, from 0 to about 30 weight percent of detergent, from 0 to about 10 weight percent of at least one oxidation inhibitor, from 0 to about 1 weight percent of at least one foam inhibitor, and from 0 to about 20 weight percent of at least one viscosity improver, wherein the base oil comprises a mixture of trimer and higher oligomers derived from an alpha olefin feed consisting essentially of 1-tetradecene and wherein said oligomer mixture contains less than 2 weight percent of combined monomer and trimer.

28. The engine oil of claim 27 wherein the base oil consists of trimer and higher oligomers derived from said 1-tetradecene.

* * * * *

US006313077C1

(12) INTER PARTES REEXAMINATION CERTIFICATE (0430th)

United States Patent

Stunnenberg et al.

(10) Number: US 6,313,077 C1

(45) Certificate Issued: Aug. 21, 2012

(54) USE OF POLYALPHAOLEFINS (PAO) DERIVED FROM DODECENE OR TETRADECENE TO IMPROVE THERMAL STABILITY IN ENGINE OIL IN AN INTERNAL COMBUSTION ENGINE

(76) Inventors: Frank Stunnenberg, Diemen (NL); Perla Duchesne, Notredame de Gravenchon (FR); Jurgen H. Raddatz, Darmstadt-Eberstadt (DE)

Reexamination Request:
No. 95/001,820, Nov. 16, 2011

Reexamination Certificate for:

| | |
|---|---|
| Patent No.: | **6,313,077** |
| Issued: | **Nov. 6, 2001** |
| Appl. No.: | **09/624,286** |
| Filed: | **Jul. 24, 2000** |

(51) Int. Cl.

| | |
|---|---|
| ***C10M 107/10*** | (2006.01) |
| ***C10M 111/04*** | (2006.01) |
| ***C10M 107/00*** | (2006.01) |
| ***C10M 111/00*** | (2006.01) |

(52) U.S. Cl. ..... 508/591; 585/10; 585/12; 585/18

(58) Field of Classification Search ..... None
See application file for complete search history.

(56) References Cited

To view the complete listing of prior art documents cited during the proceeding for Reexamination Control Number 95/001,820, please refer to the USPTO's public Patent Application Information Retrieval (PAIR) system under the Display References tab.

*Primary Examiner*—Jerry D Johnson

(57) ABSTRACT

The present invention relates to compositions of base oils and automotive engine oils using synthetic poly alpha olefins derived from 1-dodecene or 1-tetradecene to improve engine oil performance as demonstrated by the severe Volkswagen T-4, Volkswagen TDI, and Sequence IIIE tests.

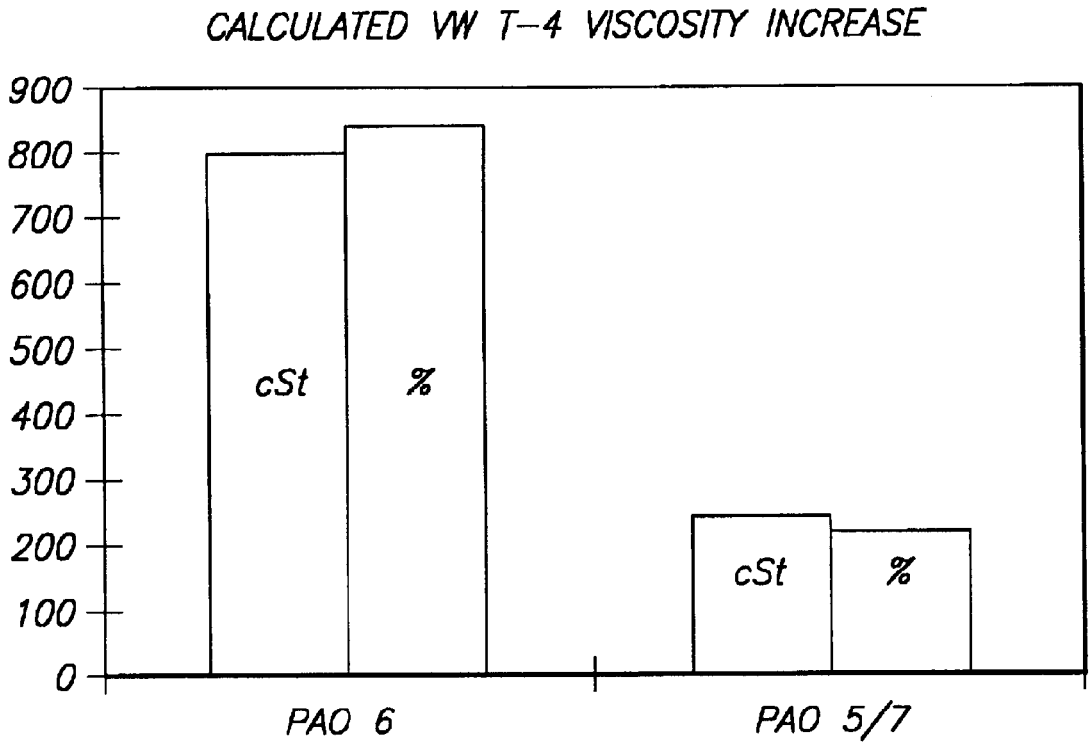

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-28 are cancelled.

* * * * *